US005263617A

United States Patent [19]

Martin

[11] Patent Number: 5,263,617

[45] Date of Patent: Nov. 23, 1993

[54] GARMENT WAISTBAND EXPANDER APPARATUS

[76] Inventor: Bernard E. Martin, 2605 Norment Rd. SW., Albuquerque, N. Mex. 87105

[21] Appl. No.: 988,858

[22] Filed: Dec. 10, 1992

[51] Int. Cl.[5] ..... D06C 15/00; D06C 5/00

[52] U.S. Cl. ..... 223/63; 223/77; 223/75; 223/61; 38/102.3

[58] Field of Search ..... 223/72, 74, 61, 63, 223/75, 77, 84; 38/102, 102.3

[56] References Cited

U.S. PATENT DOCUMENTS 2,999,619 9/1961 Thorne ..... 223/74
3,015,422 1/1962 DeFino ..... 223/74
3,417,905 12/1968 Aloi ..... 223/74
4,483,467 11/1984 Hostetler et al. ..... 223/74
4,593,839 6/1986 Vandoros ..... 223/63

FOREIGN PATENT DOCUMENTS 2020036 3/1973 Fed. Rep. of Germany ..... 223/72

*Primary Examiner*—Clifford D. Crowder
*Assistant Examiner*—Bibhu Mohanty
*Attorney, Agent, or Firm*—Leon Gilden

[57] ABSTRACT

Arranged for positioning within a waist portion of a garment, the apparatus includes first and second plate members arranged for retraction and projection relative to one another, having a cam plate intermediate the first and second plates to effect the expansion and contraction of the plates.

5 Claims, 4 Drawing Sheets

GARMENT WAISTBAND EXPANDER APPARATUS

BACKGROUND OF THE INVENTION

1. Field of the Invention

The field of invention relates to garment stretching apparatus, and more particularly pertains to a new and improved garment waistband expander apparatus arranged for positioning within a waist portion of a garment to effect localized stretching of the garment.

2. Description of the Prior Art

Garment stretching structure is indicated in the prior art and exemplified by the U.S. Pat. Nos. 4,593,839; 4,429,439; 4,364,495; 3,865,285; and 4,538,370.

The instant invention attempts to overcome deficiencies of the prior art by employing an expander structure having expandable plates arranged for projection relative to one another for effecting the stretching of a waistband of an associated garment such as trousers.

SUMMARY OF THE INVENTION

In view of the foregoing disadvantages inherent in the known types of garment expander structure now present in the prior art, the present invention provides a garment waistband expander apparatus wherein the same includes adjacent plates arranged for projection relative to one another within a waistband of a garment. As such, the general purpose of the present invention, which will be described subsequently in greater detail, is to provide a new and improved garment waistband expander apparatus which has all the advantages of the prior art garment expander structure and none of the disadvantages.

To attain this, the present invention provides an apparatus including first and second plate members arranged for retraction and projection relative to one another, having a cam plate intermediate the first and second plates to effect the expansion and contraction of the plates.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved garment waistband expander apparatus which has all the advantages of the prior art garment expander apparatus and none of the disadvantages.

It is another object of the present invention to provide a new and improved garment waistband expander apparatus which may be easily and efficiently manufactured and marketed.

It is a further object of the present invention to provide a new and improved garment waistband expander apparatus which is of a durable and reliable construction.

An even further object of the present invention is to provide a new and improved garment waistband expander apparatus which is susceptible of a low cost of manufacture with regard to both materials and labor, and which accordingly is then susceptible of low prices of sale to the consuming public, thereby making such garment waistband expander apparatus economically available to the buying public.

Still yet another object of the present invention is to provide a new and improved garment waistband expander apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
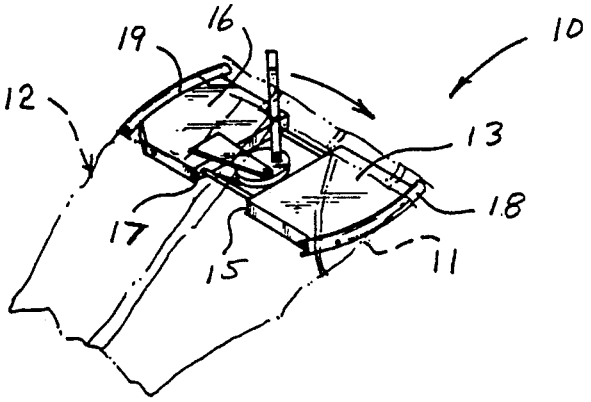
FIG. 1 is an isometric illustration of the invention in use.

With reference now to the drawings, and in particular to FIGS. 1 to 8 thereof, a new and improved garment waistband expander apparatus embodying the principles and concepts of the present invention and generally designated by the reference numeral 10 will be described.

More specifically, the garment waistband expander apparatus 10 of the instant invention is arranged for positioning within a waistband 11 of a garment 12, as indicated in FIG. 1. The apparatus includes a first plate 13 cooperative with a second plate 16, with the first plate 13 having a first plate outer arcuate end wall 14 spaced from a first plate interior end wall 15. The second plate 16 has a second plate outer arcuate end wall 16*a* spaced from a second plate interior end wall 17, with the first plate and second plate respective outer arcuate end walls 14 and 16*a* having respective resilient first and second bumpers 18 and 19 fixedly mounted and at least coextensive with the respective first and second plate outer arcuate end walls 14 and 15 for enhanced gripping engagement within the waistband 11 of the garment 12.

Figure 2:
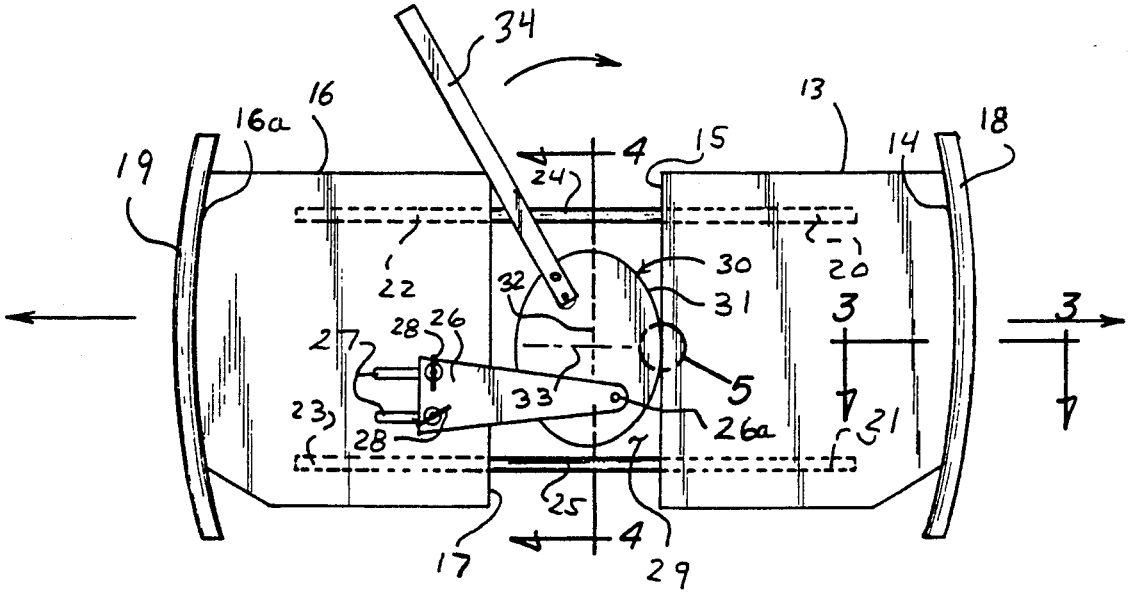
FIG. 2 is an orthographic top view of the invention.
Figure 3:
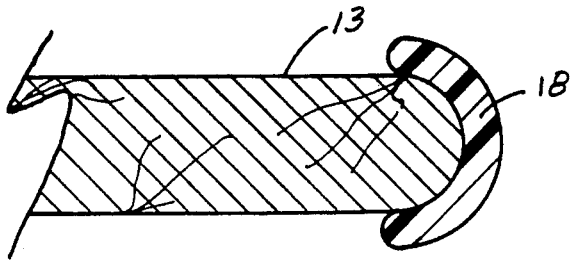
FIG. 3 is an orthographic view, taken along the lines 3—3 of FIG. 2 in the direction indicated by the arrows.
Figure 4:
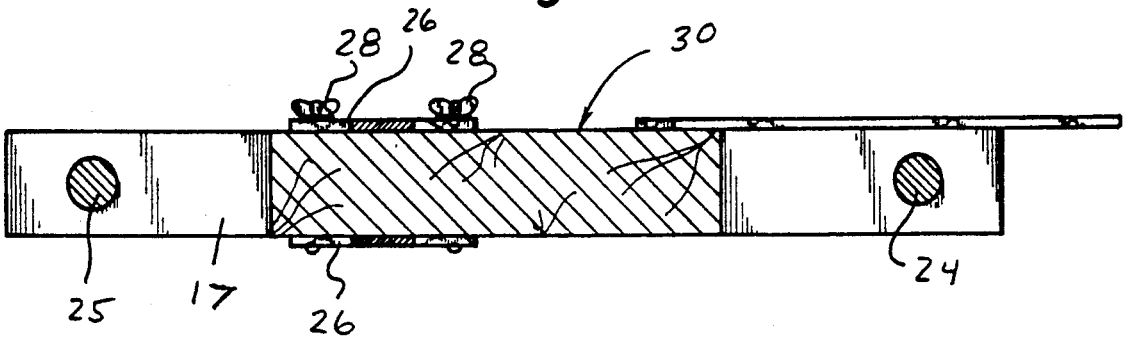
FIG. 4 is an orthographic view, taken along the lines 4—4 of FIG. 2 in the direction indicated by the arrows.
Figure 5:
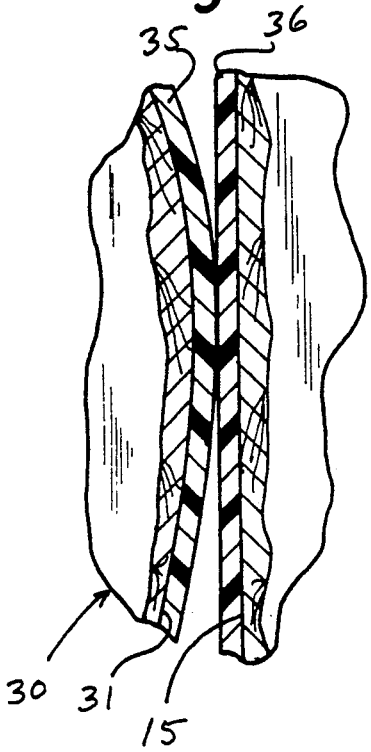
FIG. 5 is an orthographic view, partially in cross-section of section 5 as set forth in FIG. 2.

The first plate 13 having a first plate first bore spaced from and parallel a first plate second bore 21 directed into the first plate from the first plate interior end wall 15. The second plate having a second plate first bore and a second plate second bore 22 and 23 respectively orthogonally directed into the second plate from the second plate interior end wall 17. The first plate first bore 20 and the second plate first bore 22 are coaxially aligned, with the first plate second bore 21 and the second plate second bore 23 coaxially aligned. A first rod 24 is slidably received within the first and second plate first bores, and a second rod 25 slidably mounted within the first and second plate second bores 21 and 24, and accordingly the first and second rods 24 and 25 are arranged in a parallel relationship to provide for the expansion and retraction of the first and second plates relative to one another, as indicated in FIG. 2. To effect such expansion, a cam plate 30 is provided positioned within a gap 29 between the second plate interior end wall 17 and the first plate interior end wall 15. Mounting of the cam plate 30 is effected by positioning of the cam plate between spaced parallel mounting plates 26 mounted to spaced parallel top and bottom walls of the second plate 16. The second plate 16 includes parallel slots 27, with the parallel slots 27 each having a fastener 28 directed therethrough, with each fastener 28 directed through the mounting plates 26 in an orthogonal relationship (see FIG. 4) for adjustably mounting the mounting plates 26 orthogonally relative to the second plate interior end wall 17. A cam plate axle 26*a* orthogonally directed through the mounting plates 26 and the cam plate is provided to pivotally mount the cam plate. The cam plate 30 is of a substantially elliptical configuration having a major and minor axis 32 and 33 respectively defining a predetermined major axial length and a predetermined minor axial length along the respective major and minor axes 32 and 33. Typically, the cam plate axle 26*a* is positioned on a first side of the minor axis 33, with a handle 34 mounted fixedly to the cam plate 30 to a second side of the minor axis 33 to provide for effective manual rotation of the cam plate 30. The cam plate 30 includes a cam plate periphery 31 for abutment with the first plate interior end wall 15 to thereby effect projection of the first plate 13 relative to the second plate 16 in a spaced relationship upon rotation of the cam plate in engagement with the first plate interior end wall 15. To ease such confronting relationship of the cam plate periphery 31, a rigid bearing strip 35 is mounted coextensively about the cam plate periphery 31 (see FIG. 5) and typically, such bearing strips may be formed of TEFLON. Further, a first plate bearing strip 36 is mounted along the first plate interior end wall 15 to ease the confronting and sliding relationship of the cam plate periphery relative to the first plate interior end wall 15.

Figure 6:
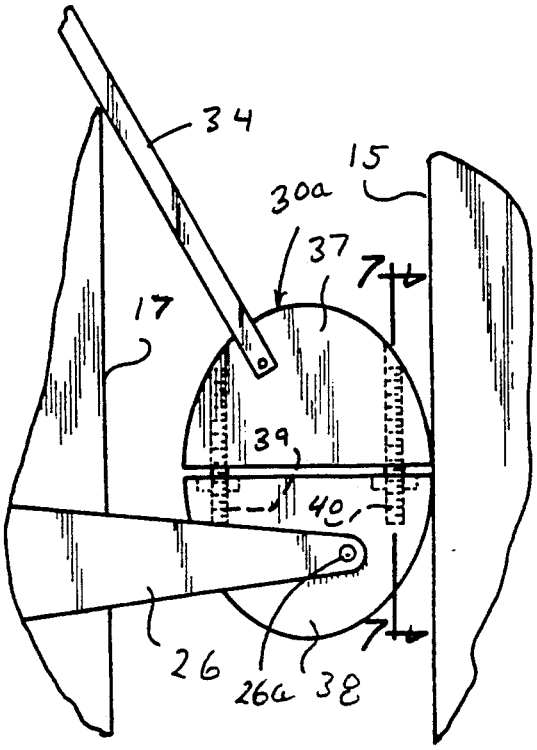
FIG. 6 is an orthographic top view of a modified cam plate structure of the invention.
Figure 7:
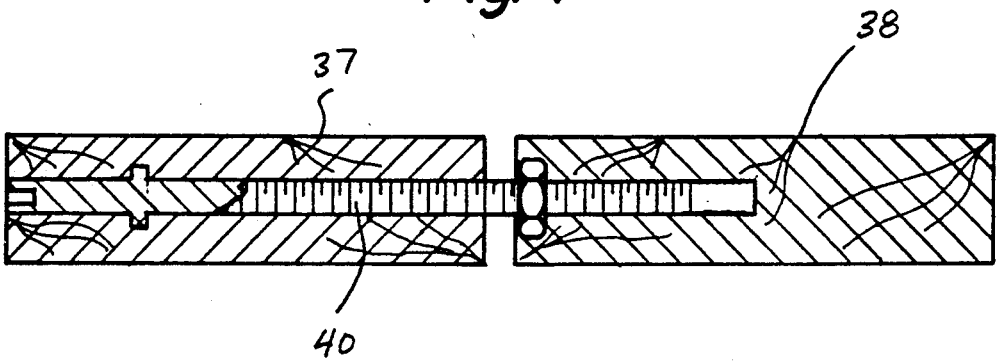
FIG. 7 is an orthographic view, taken along the lines 7—7 of FIG. 6 in the direction indicated by the arrows.
Figure 8:
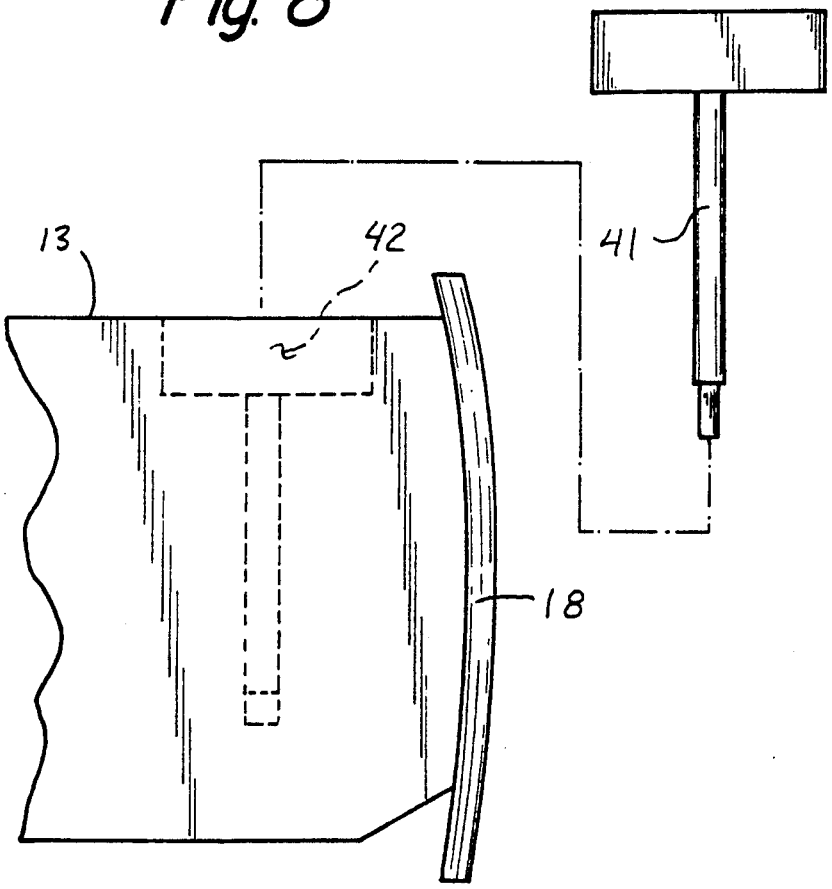
FIG. 8 is an orthographic view of the first plate member having a removable tool mounted therein for effecting adjustment of the cam plate structure, as indicated in FIG. 6.

The FIG. 6 indicates the use of a modified cam plate 30*a*, having a first and second cam plate portion 37 and 38 split along the minor axis 33. Respective first and second externally threaded adjuster rods 39 and 40 are provided, with each adjuster rod rotatably mounted within the first cam plate portion 37 and threadedly received within the second cam plate portion to effect ease of separation of the first cam plate relative to the second cam plate employing a tool 41 received within the adjuster rods for such rotation. The tool member 41 for convenience is mounted within a tool member socket 42 (see FIG. 8) directed into a side wall of the first plate 13. The tool member 41 is typically formed with a polygonal end for receiving within a polygonal socket for rotation of the adjuster rod structure in a manner to form a non-slip relationship between the tool and the associated adjuster rod structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A garment waistband expander apparatus arranged for positioning within a waistband portion of a garment, wherein the apparatus comprises, a first plate and a second plate, the first plate having a first plate outer arcuate end wall, and the second plate having a second plate arcuate end wall for engagement with the waistband of the garment, and the first plate having a first plate interior end wall spaced from the first plate outer arcuate end wall, and the second plate having a second plate interior end wall spaced from the second plate outer arcuate end wall, the first plate interior end wall and the second plate interior end wall arranged in a spaced parallel relationship to define a gap therebetween, and cam means mounted to the second plate for engagement with the first plate for effecting separation of the first plate interior end wall relative to the second plate interior end wall, and the cam means is mounted within the gap, and spaced parallel slots directed through the second plate, with the slots orthogonally oriented relative to the second plate interior end wall, and the slots mounting spaced parallel mounting plates, and the cam means includes a cam plate mounted between the mounting plates, the cam plate having a major axis and a minor axis, with the major axis having a first length, the minor axis having a second length, wherein the first length is greater than the second length, and the cam plate having a cam plate axle directed through the cam plate on a first side of the minor axis and orthogonally directed through the mounting plates within the gap, and a handle mounted fixedly to the cam plate on a second side of the minor axis to effect rotation of the cam plate, with the cam plate having a cam plate periphery and the cam plate periphery in engagement with the first plate interior end wall, whereupon rotation of the handle effects displacement of the first plate relative to the second plate.

2. An apparatus as set forth in claim 1 wherein the first plate includes a first plate first bore and a first plate second bore directed into the first plate from the first plate interior end wall, and the first plate first bore and the first plate second bore arranged parallel relative to one another, and the second plate having a second plate first bore and a second plate second bore directed into the second plate from the second plate interior end wall, and the second plate first bore and the second plate second bore are parallel relative to one another, and a first rod slidably received within the first plate first bore and the second plate first bore, and a second rod slidably received within the second plate second bore and the first plate second bore, and the first rod and the second rod arranged in a parallel relationship, with the cam plate positioned between the first rod and the second rod.

3. An apparatus as set forth in claim 2 including a rigid cam bearing strip fixedly mounted to the cam plate periphery, and a rigid first plate bearing strip fixedly mounted to the first plate interior end wall to provide for sliding engagement of the cam plate periphery relative to the first plate interior end wall.

4. An apparatus as set forth in claim 3 wherein the cam plate includes a first cam plate portion and a second cam plate portion, and the first cam plate portion is separated from the second cam plate portion along the minor axis, and a first adjuster rod and a second adjuster rod arranged in a parallel relationship threadedly directed into the second cam plate from the first cam plate, and the first adjuster rod and the second adjuster rod rotatably mounted within the first cam plate.

5. An apparatus as set forth in claim 4 including a tool member arranged for engagement with the first adjuster rod and the second adjuster rod selectively for effecting selective rotation of the first adjuster rod and the second adjuster rod, and a tool member socket directed into the first plate to complementarily receive and secure the tool member therewithin.

* * * * *